US005868506A

United States Patent [19]

Seybold

[11] Patent Number: 5,868,506

[45] Date of Patent: Feb. 9, 1999

[54] SELECTIVE INKING CASSETTE

[75] Inventor: James M. Seybold, Centerville, Ohio

[73] Assignee: NCR Corporation, Dayton, Ohio

[21] Appl. No.: 64,213

[22] Filed: Apr. 22, 1998

[51] Int. Cl.[6] ..... B41J 27/12

[52] U.S. Cl. ..... 400/197; 400/200

[58] Field of Search ..... 400/197, 196.1, 400/200, 202.3

[56] References Cited

U.S. PATENT DOCUMENTS 2,745,533 5/1956 Keleher ..... 400/200
4,747,711 5/1988 Motta et al. ..... 400/196.1
5,314,257 5/1994 Cheng ..... 400/202.3
5,399,033 3/1995 Putman ..... 400/197
5,567,065 10/1996 Cai et al. ..... 400/197

*Primary Examiner*—Edgar Burr
*Assistant Examiner*—Minh H. Chau
*Attorney, Agent, or Firm*—Francis L. Conte

[57] ABSTRACT

A printer cassette includes a housing containing a ribbon in a channel, and ink in a well. An ink wheel is rotatably mounted to the housing in operable engagement with the ribbon. A wick extends from the well and includes a stem elastically cantilevered from a base thereof at the well to a tip thereof between which is disposed the ink wheel in contact therewith. The wick stem converges to selectively transfer ink to the ink wheel.

11 Claims, 4 Drawing Sheets

SELECTIVE INKING CASSETTE

BACKGROUND OF THE INVENTION

The present invention relates generally to printer ribbon cassettes, and, more specifically, to re-inking cassettes.

One type of printer ribbon cassette includes an endless ribbon disposed inside a cassette housing for being removably inserted into a corresponding printer. The ribbon is saturated with ink and is driven by the printer for cyclical use until the ink is depleted.

In order to ensure a suitable useful life, the cassette typically includes an inkwell having a foam insert or pad therein saturated with an additional volume of ink. A wick extends from the well and frictionally engages an ink wheel for continuously transferring ink from the well to the wheel, and in turn to the ribbon for replenishing the ribbon ink. In one embodiment, the ink wheel is in the form of a gear which cooperates with a mating gear, and between which is driven the ribbon in an endless loop. As the printer removes ink from the ribbon as each character is formed, the ink wheel resupplies the ribbon with ink removed from the well. In this way, each cassette may achieve a useful life typically expressed in millions of characters, such as five million for example.

Cassette life is the primary performance factor. This requires the ability to produce several million printed characters of suitable darkness. Insufficient or excess ink transfer to the ribbon during operation is undesirable since the former results in faded characters, and the latter may result in character smudging and possibly ink leaking from the cassette. Excessive ink transfer between the wick and ink wheel may accumulate ink on the wheel which falls by gravity to the bottom of the cassette and can leak through holes therein such as the bushing supporting the ink wheel itself.

Printer cassette Model No. 7141 manufactured and sold by the NCR Corporation is an example of a re-inking cassette enjoying commercial success for many years. Cassette performance and life are controlled in most part by the formulation of the ink used; the material and configuration of the foam ink pad and wick associated with the well; the configuration of the ink wheel; and the construction of the fabric ribbon. These components are interrelated in operation for ensuring the continuous re-inking of the ribbon as it travels through the cassette in repeated cycles for printing characters of acceptable darkness without premature character fading or ink leaking.

However, a statistically significant number of this exemplary cassette has failed to meet the desired minimum character life specification, and has led to the discovery of the present invention.

SUMMARY OF THE INVENTION

A printer cassette includes a housing containing a ribbon in a channel, and ink in a well. An ink wheel is rotatably mounted to the housing in operable engagement with the ribbon. A wick extends from the well and includes a stem elastically cantilevered from a base thereof at the well to a tip thereof between which is disposed the ink wheel in contact therewith. The wick stem converges to selectively transfer ink to the ink wheel.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
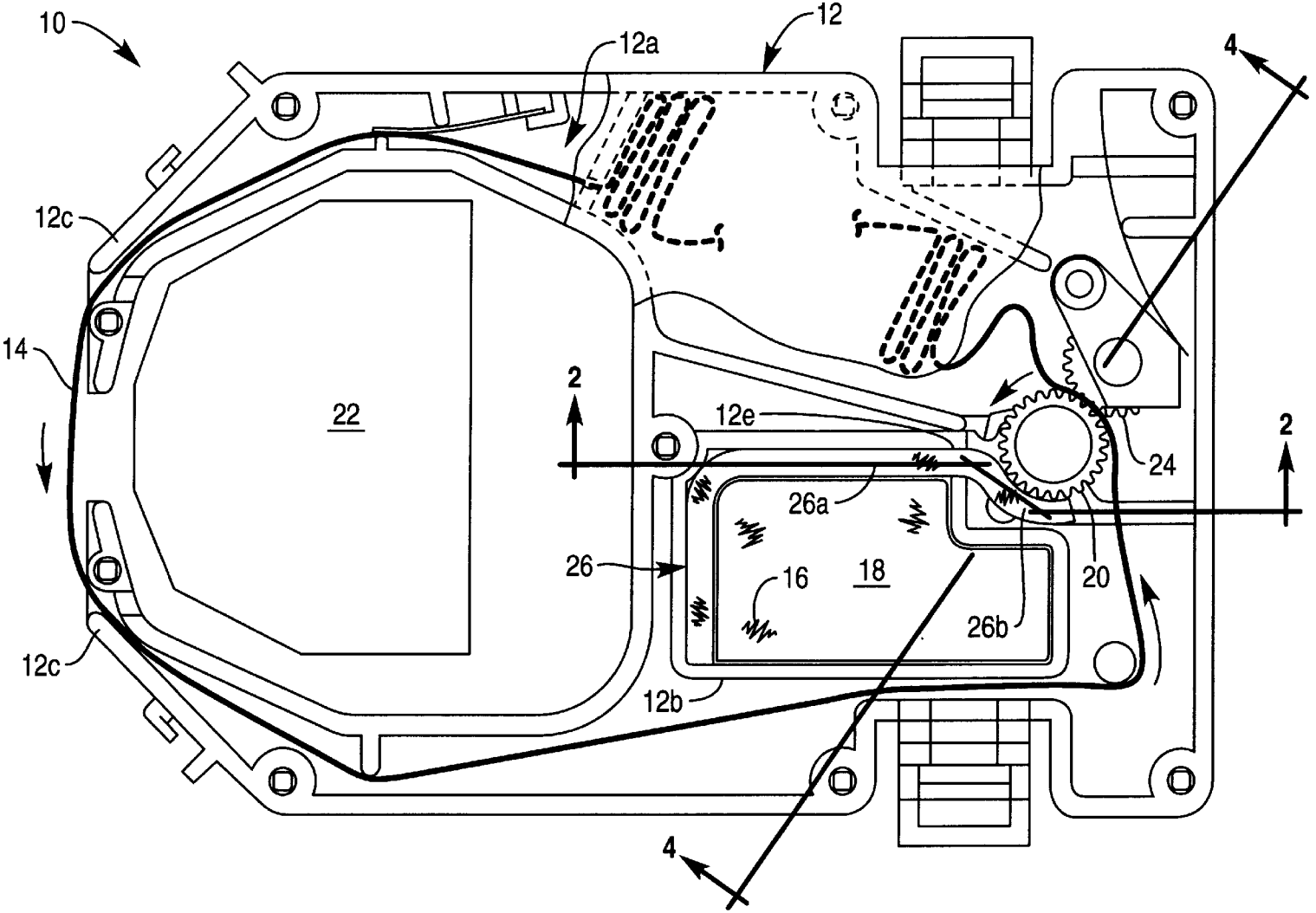
FIG. 1 is a top plan view of a printer cassette including a wick engaging an ink wheel in accordance with an exemplary embodiment of the present invention.

Illustrated in FIG. 1, is a printer ribbon cassette 10 in accordance with an exemplary embodiment of the present invention. The cassette includes a molded plastic housing 12 which is configured to define a closed-loop ribbon channel or pathway 12*a*, and an ink reservoir or well 12*b*. A printing ribbon 14 in the form of an endless fabric loop is disposed or threaded in the ribbon channel 12*a* which controls its movement through the cassette during operation.

Liquid ink 16 is disposed or stored in the inkwell 12*b* for use in re-inking the ribbon 14, which is initially provided saturated with the same ink. In order to trap the ink in the cassette and reduce the likelihood of ink leaking, the ink 16 is stored in an open-cell foam ink pad 18 which fills most of the inkwell 12*b*.

A plastic ink wheel 20 is rotatably mounted to the housing 12 adjacent the inkwell 12*b* in operable engagement with a portion of the ribbon 14. In this embodiment, the ink wheel 20 also drives the ribbon 14 through the cassette.

The basic cassette 10 may take any suitable configuration such as the NCR Model No. 7141 described above. For example, the cassette housing 12 may be formed in two pieces, with a lower piece being a molded part including a bottom wall, side walls, and internal partitions which define the ribbon channel 12*a* and inkwell 12*b*. And, a separate one piece cover completes the housing for trapping the ribbon and cooperating parts therein.

The housing 12 includes a pair of symmetrical arms 12*c* which are spaced apart at corresponding ends thereof to expose a portion of the ribbon 14 between a conventional printer 22 and the printing paper (not shown). The printer 22 includes a printing head around which the cassette's arms are mounted so that the exposed portion of the ribbon 14 between the arms may be accessed by the printer for printing characters on the paper.

In the exemplary embodiment illustrated, the ink wheel 20 is in the form of a gear having suitable gear teeth which engage the ribbon 14 for driving it during operation. A second, idler gear 24 cooperates with the driving ink gear 20 trapping the ribbon 14 therebetween for driving the ribbon in a circuitous path through the cassette during operation. The second gear 24 is rotatably mounted to a spring loaded support arm for biasing the second gear 24 in engagement with the ribbon and cooperating ink gear 20.

Figure 2:
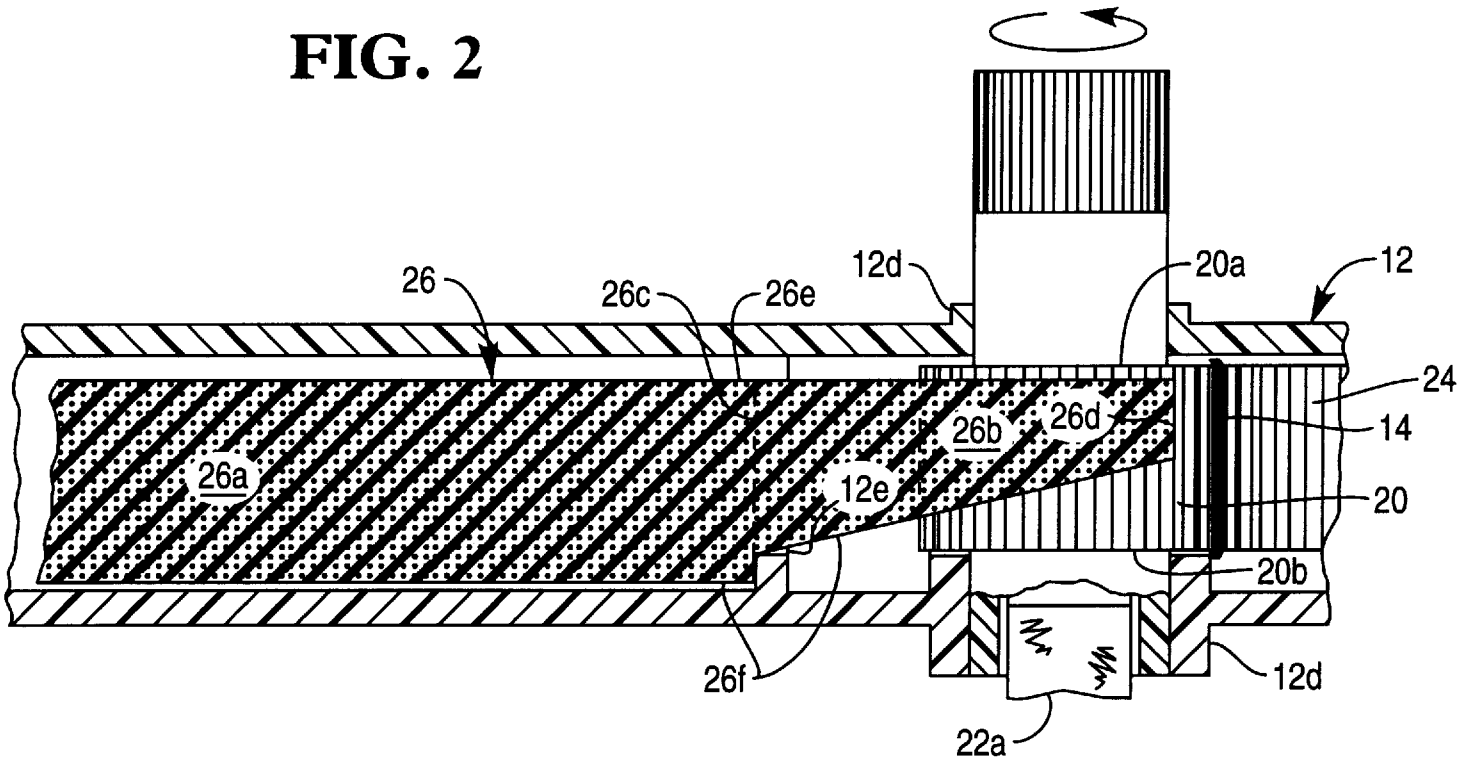
FIG. 2 is a partly sectional view through the wick and wheel illustrated in FIG. 1 and taken generally along line 2—2.

As shown in more particularity in FIG. 2, the ink gear 20 includes an integral central drive shaft which extends in opposite directions through corresponding bushings 12*d* integrally formed in the top and bottom of the housing 12. The gear 20 is bottom driven during operation by a driven spindle 22*a* of the printer which engages a corresponding socket in the bottom end of the drive shaft. The top end of the drive shaft has additional gear teeth for allowing manual turning of the gear 20 when desired.

The cassette 10 as above described is conventional in configuration and function. It is readily mounted to its corresponding printer 22 for allowing the gears 20, 24 to drive the ribbon 14 during operation as the spindle 22*a* is driven. In this way, a fresh portion of the ribbon 14 is continually presented to the printer 22 for printing characters in turn on the printing paper.

In accordance with the present invention, the cassette 10 includes an improved wick 26 for transferring the ink 16 from the ink pad 18 to the ink wheel 20 and in turn to the ribbon 14 during operation. The wick 26 is illustrated from the top in FIG. 1 and from its side in elevation in FIG. 2. The wick 26 has opposite end portions in the form of a root 26*a* disposed inside the inkwell 12*b*, and an integral extension or stem 26*b* disposed outside the inkwell 12*b*. The wick 26 itself is preferably a one-piece component which wicks the ink 16 from the ink pad 18 by capillary action to continuously re-ink the ink wheel 20, which in turn re-inks the ribbon 14.

The wick stem 26*b* is resiliently biased in contact with a portion of the ink wheel 20 by being elastically cantilevered from a base section 26*c*, defined by the intersection of the root 26*a* and stem 26*b*, to a tip 26*d* at the distal end.

As shown in FIG. 1, the ink pad 18 entirely fills the inkwell 12*b* except around two sides thereof along which is disposed the wick root 26*a*, which, with the ink pad 18, completely fills the inkwell. The ink pad and wick are preferably formed of the same ink absorbing material, which, for example, may be an open-cell foam of a suitable material such as polyurethane polyester. The foam material traps the ink 16 therein preventing undesirable leakage in the cassette, yet allows the ink to move by capillary action through the wick to the ink wheel 20 for re-inking the ribbon 14 during operation.

The wick root 26*a* as illustrated in FIG. 1 extends straight through a well outlet 12*e* into the inkwell 12*b* and bends sharply at the opposing corner of the well and continues straight to the next corner of the well. In this way, suitable contact area is created between the wick root and the ink pad for ensuring suitable flow of the ink 16 from the pad to the wick and in turn to the ink wheel 20. Furthermore, since the wick is preferably a one-piece component this mounting arrangement of the wick root 26*a* inside the inkwell 12*b* structurally supports the wick stem 26*b* which extends outwardly from the well outlet 12*e* as an otherwise unsupported cantilever beam.

As shown in FIG. 1, the ink wheel 20 is generally colinearly aligned with both the well outlet 12*e* and the straight portion of the wick root 26*a* extending therethrough so that the wick stem 26*b* is elastically deflected by the ink wheel 20 in a partial arc between the base 26*c* and tip 26*d* of the wick stem. The side surface of the wick stem 26*b* therefore engages several of the gear teeth on the ink wheel 20 over an arcuate extent of about 60°. This allows ink from the wick to be transferred to the ink wheel 20 as the wheel frictionally engages or rubs the wick stem under the pressure exerted by the elastic deflection of the cantilevered wick stem.

In this way, the ink wheel 20 engages the wick stem 26*b* on one side, and engages the ribbon 14 on an opposite side. Ink is removed from the wick stem by successive gear teeth and carried with the rotating ink wheel and deposited on the ribbon 14 engaging the gear teeth on its opposite side.

In the prior art cassette identified in the background, a straight wick with a constant height wick stem has been used for maximizing ink transfer from the inkwell along the full height of the ink wheel. However, since the wick must necessarily be assembled into the cassette, it is subject to misalignment during assembly which may cause the wick stem to overextend either the top or bottom of the gear teeth on the ink wheel 20. This is undesirable since such overextension can lead to an excess transfer of ink thereat which in turn may lead to undesirable ink leakage from the cassette itself through the bottom mounting bushing 12*d* for example. Nevertheless, the wick should still transfer ink along substantially the entire vertical extent of the gear teeth for corresponding transfer over the height of the ribbon.

As indicated above in the background section, another problem occasionally experienced with the prior art cassette was premature character fading due to insufficient ink in the ribbon prior to the desired minimum life requirement. In order to correct this problem, the ink gear, such as the gear 20, was provided without its lubricating coating for increasing the amount of ink transfer from the wick to the ribbon. This was successful in increasing the number of characters printed without fading, but introduced the associated problem of excess ink transfer to the wheel leading to ink leakage from the cassette through the bottom mounting bushing.

In order to solve this leaking problem due to excess ink transfer to the ink wheel, a reduced-length wick stem was built and tested for decreasing the surface contact area with the ink gear over an arc length substantially smaller than the nominal 60°. However, this proposed solution was unsuccessful when tested to reduce ink transfer to the wheel and eliminate ink leakage therefrom.

Another solution has been discovered, built, and successfully tested forming the basis of an improved printer cassette in accordance with the present invention.

In its simplest embodiment, the improved cassette 10 includes the wick 26 with its wick stem 26*b* converging from the base 26*c* to the tip 26*d* for selectively transferring the ink to the ink wheel 20 for adequately supplying the ribbon 14 with ink to prevent character fading before the desired minimum life of the cassette.

Figure 3:
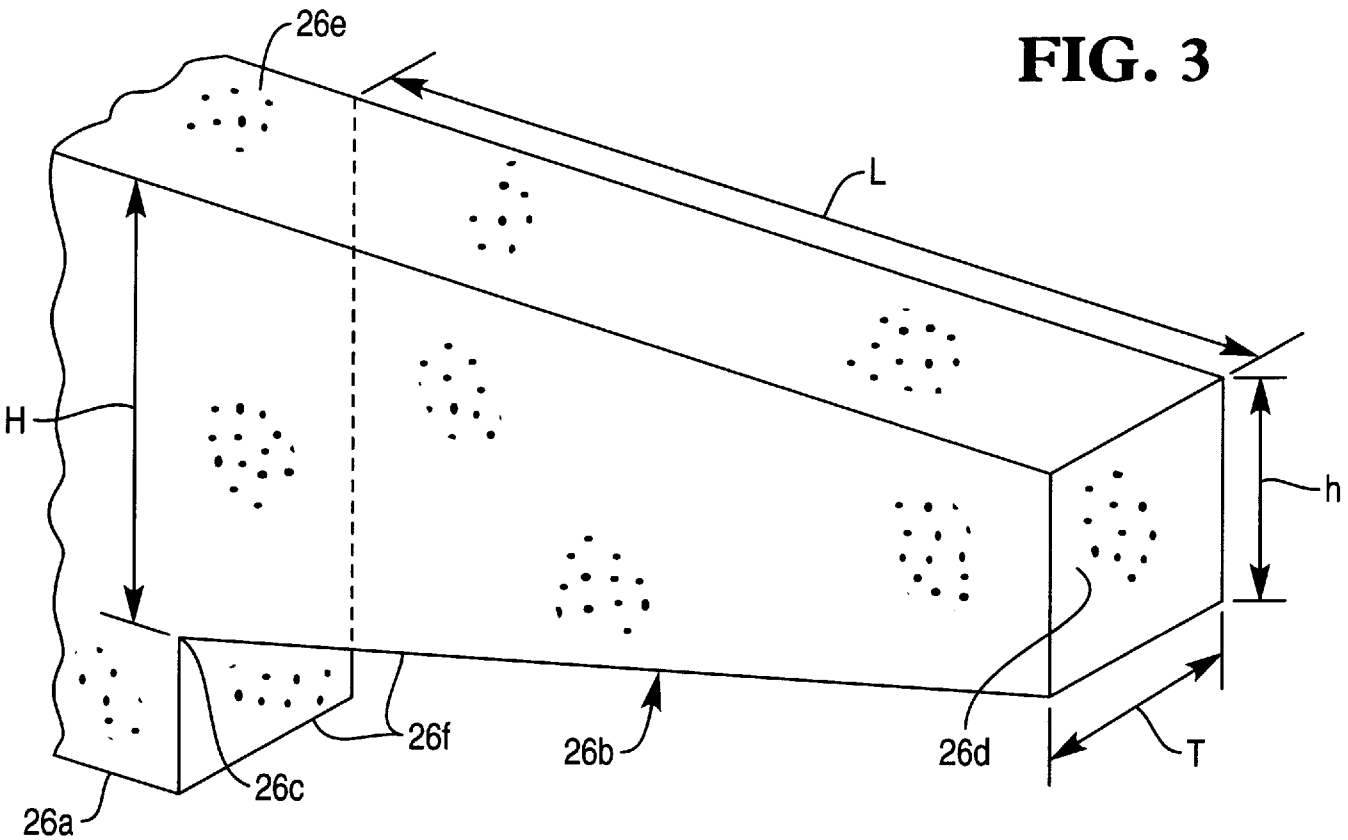
FIG. 3 is an isolated isometric view of the wick stem illustrated in FIGS. 1 and 2.

As shown in FIGS. 2 and 3, the wick stem 26*b* preferably decreases in cross-sectional area between the base 26*c* and the tip 26*d* for decreasing ink transfer to the ink wheel 20. As shown in FIG. 3, the wick stem 26*b* has a length L between its base and tip, a lateral thickness T, and a maximum height H at its base 26*c*. The height of the wick root 26*a* is suitably larger than that of the wick stem to provide a corner or step at the intersecting base 26*c* therebetween for physically trapping the wick inside the inkwell through the well outlet 12*e* in a conventional manner as illustrated in FIG. 2. The wick root 26*a* preferably has a rectangular cross section which is constant along the entire length of the root up to the base section 26*c* joining the root to the stem.

In accordance with the present invention, there are various embodiments for decreasing cross-sectional area of the wick stem for suitably decreasing ink transfer to the ink wheel 20, but this must be accomplished without undesirably decreasing the stiffness of the wick stem 26*b* itself since it is this stiffness which effects the elastic engaging force of the wick stem against the ink wheel 20. Since ink transfer to the ink wheel is effected by the amount of pressure exerted between the wick stem and the gear teeth, changing the configuration of the cantilevered wick stem also changes the resulting engagement force on the ink wheel 20.

Figure 4:
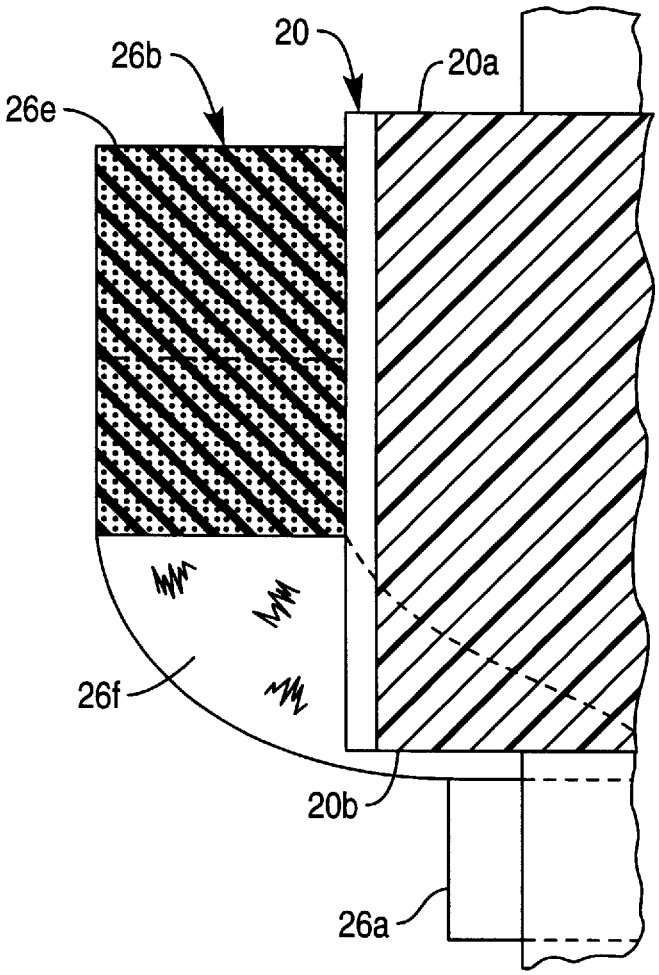
FIG. 4 is an elevational, partly sectional view of the wick stem engaging the ink wheel illustrated in FIG. 1 and taken generally along line 4—4 therein.

As shown in side view in FIG. 2, and in end view in FIG. 4, the wick stem 26*b* is preferably configured so that it contacts the ink wheel 20 with decreasing contact surface area between the base 26*c* and the tip 26*d* thereof. The ink wheel 20 has opposite top and bottom ends 20*a,b*, and the wick stem 26*b* is preferably disposed therebetween closer to one of the ends, such as the top end 20*a*. In this way, selected distribution of the ink from the wick stem 26*b* to the ink wheel 20 may be obtained.

As shown in FIG. 3, the wick stem 26*b* preferably has a constant thickness T between the base 26*c* and the tip 26*d*. This constant thickness is equal to the constant thickness of the integral wick root 26*a* for maximizing the bending stiffness of the wick stem under deflection caused by the abutting ink wheel 20. To decrease the cross-sectional area of the wick stem, it preferably decreases in height between the base 26*c* and the tip 26*d*, with a maximum height H at the former and a minimum height h at the latter, which may be about 55% of the former for example. The cross-section of the wick remains rectangular along its entire length, but decreases in height solely over the length L of the wick stem portion 26*b*.

As shown in FIGS. 2 and 3, the wick 26 further includes top and bottom edges or surfaces 26*e,f*. The top edge 26*e* is preferably straight and colinear along the full length of the root 26*a* and stem 26*b*. The bottom edge 26*f* is parallel to the top edge along the root 26*a*, but converges toward the top edge along the length L of the wick stem 26*b*. Since the entire wick 26 may be conventionally formed by cutting from a constant thickness foam sheet, this preferred embodiment minimizes differences in the configuration of the wick for increasing the ease of manufacture. The uninstalled wick 26 is otherwise a straight rectangular beam with a small cutout at one end to define the converging constant thickness wick stem 26*b*.

As shown in FIGS. 2 and 4, the wick top edge 26*e* is preferably disposed closer to the wheel top end 20*a* than the wick bottom edge 26*f* is disposed adjacent to the wheel bottom end 20*b*. In this way, the top edge of the entire wick is aligned parallel with and just below the top end 20*a* of the ink wheel 20 in a conventional manner for reducing the likelihood of overextension of the wick stem above the ink wheel upon assembly. Since the bottom edge 26*f* of the wick stem 26*b* is angled upwardly for decreasing the cross-sectional area of the stem to its tip, the spacing between the bottom edge 26*f* and the bottom end 20*b* of the ink wheel 20 correspondingly increases.

The wick stem 26*b* preferably converges linearly between the base 26*c* and the tip 26*d*, with the bottom edge 26*f* being straight. The cross-section of the wick stem 26*b* remains rectangular with the same thickness T as the wick root 26*a* for maximizing bending stiffness in this direction under the deflection of the abutting ink wheel 20. FIGS. 1 and 4 illustrate this deflection of the wick stem when trapped between the inkwell 12*b* and the ink wheel 20 after installation. As shown in FIG. 2, the largest cross-section of the wick stem 26*b* is maintained between the supported base 26*c* and the ink wheel 20 for maximizing the engagement force against the wheel 20 notwithstanding the decrease in cross-sectional area toward the tip 26*d*.

Correspondingly, the decreasing height of the wick stem 26*b* decreases the available contact surface area between the wick stem and the abutting wheel 20 to in turn decrease the total amount of ink transfer to the wheel 20. Such ink transfer, however, is nevertheless spread vertically over the entire projected height of the wick stem over its engagement with the ink wheel 20. The available ink transferred to the wheel 20 is thus preferentially reduced as compared to a full height non-tapered wick stem, but is nevertheless spread vertically over the contact height.

In an exemplary embodiment, engagement of the printer head with the ribbon 14 during operation is biased or weighted toward the upper portion of the ribbon 14 versus its center or lower portion. In this embodiment, the upwardly offset wick stem 26*b* may be used to advantage to correspond with the upper weighted printing path on the ribbon 14 to bias re-ink transfer to this region. In this way, the ink transferred from the wick to the wheel to the ribbon is preferably aligned with the specific printing path for most efficiently utilizing the available ink in the ribbon.

Since the angled or tapered wick stem 26*b* is effective for decreasing, and preferentially transferring ink to the ink wheel 20, the ink gear 20 may be initially dry and characterized by the absence of any lubricating liquid coating thereon for increasing transfer thereto of the ink from the wick stem 26*b*. As indicated above, eliminating the wheel lubricant allows an increase in ink transfer to the wheel which would otherwise be objectionable due to the resulting ink leakage. However, the tapered wick stem 26*b* decreases the ink transfer to the ink wheel to compensate for the increased capture of the ink thereon. This provides one solution for the original problem of premature ink fading from the cassette.

In alternate embodiments, the tapered wick stem 26*b* may be used with a conventional ink wheel 20 having its lubricating liquid coating thereon. The ink wheel 20 may be in the form of the exemplary gear, or may be a smooth ink roller in other embodiments.

The improved wick stem 26*b* maintains adequate structural stiffness for being resiliently deflected by the ink wheel 20, yet also selectively distributes ink to the ink wheel 20 over the desired region thereof. Excessive ink transfer to the wheel is eliminated, and the shorter height of the wick stem further increases the clearances between the stem and the top and bottom ends of the ink wheel for reducing the likelihood of wick stem overextension thusly further reducing the possibility of undesirable ink leakage.

In alternate embodiments of the invention, the wick stem 26*b* may be configured oppositely with a horizontal or parallel bottom edge and an angled or inclined top edge. Or, both the top and bottom edges of the wick stem may converge together, at the expense of a greater decrease in stiffness thereof. In yet another embodiment, the thickness of the wick stem may be varied or decreased toward the tip.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A printer cassette comprising:

a housing including a ribbon channel and an inkwell;

a ribbon disposed in said ribbon channel;

ink disposed in said well;

an ink wheel rotatably mounted to said housing adjacent said inkwell in operable engagement with said ribbon; and a wick having a root disposed inside said well, and a stem disposed outside said well in contact with said ink wheel, with said wick stem being elastically cantilevered from a base thereof at said well to a tip thereof and wherein said wick stem converges by decreasing in cross-sectional area between said base and tip for decreasing ink transfer to said ink wheel and wherein said wick stem contacts said ink wheel with decreasing area between said base and tip.

2. A cassette according to claim 1 wherein said ink wheel has opposite top and bottom ends, and said wick stem is disposed therebetween closer to one of said ends.

3. A cassette according to claim 2 wherein said wick stem has a constant thickness between said base and tip.

4. A cassette according to claim 3 wherein said wick stem decreases in height between said base and tip.

5. A cassette according to claim 4 wherein said wick further includes top and bottom edges, and said top edge is straight along said root and stem, and said bottom edge converges toward said top edge along said wick stem.

6. A cassette according to claim 5 wherein said wick top edge is disposed closer to said wheel top end than said wick bottom edge is disposed adjacent said wheel bottom end.

7. A cassette according to claim 6 wherein said wick stem converges linearly between said base and tip.

8. A cassette according to claim 1 wherein said ink wheel is a gear engaging said wick stem on one side, and engages said ribbon on an opposite side.

9. A cassette according to claim 8 wherein said wick stem is elastically deflected by said ink gear in an arc between said base and tip.

10. A cassette according to claim 8 wherein said ink gear is dry without a lubricating coating thereon for increasing transfer thereto of said ink from said wick stem.

11. A cassette according to claim 8 further comprising an ink pad disposed in said well for storing said ink therein, and both said pad and wick are formed of the same foam material.

* * * * *